US007929892B2

(12) United States Patent
Ogawa

(10) Patent No.: US 7,929,892 B2
(45) Date of Patent: Apr. 19, 2011

(54) HIGH ACCURACY MULTI-COLOR IMAGE FORMING APPARATUS AND METHOD FOR DETECTING POSITIONING COLOR IMAGE PATTERNS

(75) Inventor: Fumio Ogawa, Kanagawa (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 12/652,158

(22) Filed: Jan. 5, 2010

(65) Prior Publication Data

US 2010/0172662 A1 Jul. 8, 2010

(30) Foreign Application Priority Data

Jan. 8, 2009 (JP) ..... 2009-002353

(51) Int. Cl.
*G03G 15/01* (2006.01)

(52) U.S. Cl. ..... 399/301; 399/49

(58) Field of Classification Search ..... 399/38, 399/46, 49, 72, 297–302
See application file for complete search history.

(56) References Cited

U.S. PATENT DOCUMENTS

| | | | | |
|---|---|---|---|---|
| 6,937,826 | B2 * | 8/2005 | Yamamoto et al. | 399/49 |
| 7,162,171 | B2 * | 1/2007 | Sugiyama | 399/49 |
| 7,215,897 | B2 * | 5/2007 | Yamamoto et al. | 399/49 |
| 7,505,697 | B2 * | 3/2009 | Yamanaka et al. | 399/9 |
| 7,580,661 | B2 * | 8/2009 | Aikawa | 399/301 |
| 7,630,657 | B2 * | 12/2009 | Ehara et al. | 399/45 |
| 2007/0110485 | A1 | 5/2007 | Katsuhara et al. | |

FOREIGN PATENT DOCUMENTS

| | | | |
|---|---|---|---|
| JP | 01-167769 | B2 | 7/1989 |
| JP | 2007-114555 | A | 5/2007 |

* cited by examiner

*Primary Examiner* — Hoan Tran
(74) *Attorney, Agent, or Firm* — Kenealy Vaidya LLP

(57) ABSTRACT

In a multi-color image forming apparatus including a plurality of color image forming units adapted to form a plurality of different color images, a transfer belt to which positioning color image patterns are transferred by the color image forming units, and an optical sensor adapted to detect the positioning color image patterns, a positioning color image pattern trailing edge detecting circuit is provided to detect trailing edges of the positioning color image patterns by determining that an output signal of the optical sensor has reached a threshold value. The threshold value is a predetermined ratio of a peak value of the output signal of the optical sensor. A control circuit is provided to compensate for registration of the color image forming units in accordance with the detected trailing edges of the positioning color image patterns.

18 Claims, 21 Drawing Sheets

PRIOR ART

PRIOR ART

PRIOR ART

PRIOR ART

PRIOR ART

PRIOR ART

HIGH ACCURACY MULTI-COLOR IMAGE FORMING APPARATUS AND METHOD FOR DETECTING POSITIONING COLOR IMAGE PATTERNS

This application claims the priority benefit under 35 U.S.C. §119 to Japanese Patent Application No. JP2009-002353 filed on Jan. 8, 2009, which disclosure is hereby incorporated in its entirety by reference.

BACKGROUND

1. Field

The presently disclosed subject matter relates to a multi-color image forming apparatus such as a color electrophotographic printer, a color laser beam printer and a color print machine, and a method for detecting positioning color image patterns in a multi-color image forming apparatus.

2. Description of the Related Art

A first prior art multi-color image forming apparatus is constructed by a plurality of color image forming units for forming a plurality of different color images, a transfer belt to which positioning color image patterns are transferred by the color image forming units, an optical sensor for detecting the positioning color image patterns, and a control circuit for compensating for transfer alignment or registration of the color image forming units in accordance with the detected positioning color image patterns. The registration is required among the different color images to avoid a shift of color and change of hue. The positioning color image patterns are of a single structure (see: JP1-167769A). This will be explained later in detail.

In the above-described first prior art multi-color image forming apparatus, however, if the mounting angle of the optical sensor fluctuates, the detection accuracy of the positioning color image patterns would be reduced. As a result, the registration would be not completely compensated for.

A second prior art multi-color image forming apparatus includes positioning color image patterns of a double structure instead of those of a single structure (see: JP2007-114555A). This also will be explained later in detail.

Even in the above-described second prior art multi-color image forming apparatus, however, the detection accuracy of the positioning color image patterns is still low. As a result, the registration would be not completely compensated for either.

SUMMARY

The presently disclosed subject matter seeks to solve one or more of the above-described problems.

According to the presently disclosed subject matter, in a multi-color image forming apparatus including a plurality of color image forming units adapted to form a plurality of different color images, a transfer belt to which positioning color image patterns are transferred by the color image forming units, and an optical sensor adapted to detect the positioning color image patterns, a positioning color image pattern trailing edge detecting circuit is provided to detect trailing edges of the positioning color image patterns by determining that an output signal of the optical sensor reaches a threshold value. The threshold value is a predetermined ratio of a peak value of the output signal of the optical sensor. A control circuit is provided to compensate for registration of the color image forming units in accordance with the detected trailing edges of the positioning color image patterns. The trailing edges of the positioning color image patterns are obtained without using a gravity center calculation method.

Even if the mounting angle of the optical sensor fluctuates, the detection accuracy of the trailing edges of the positioning color image patterns would not be reduced. As a result, the registration would be completely compensated for.

Also, the optical sensor is constructed by a light emitting portion for emitting light, and a light receiving portion adapted to receive reflected light of the emitted light from the positioning color image patterns. A plane including an optical axis of the light emitting portion and an optical axis of the light receiving portion is perpendicular to a direction of propagation of the transfer belt and is inclined toward the direction of propagation of the transfer belt.

Also, according to the presently disclosed subject matter, in a method for detecting positioning color image patterns in a multi-color image forming apparatus including a plurality of color image forming units adapted to form a plurality of different color images, a transfer belt to which positioning color image patterns are transferred by the color image forming units, and an optical sensor adapted to detect the positioning color image patterns, the peak value of the output signal of the optical sensor is held. Then, the peak value is divided to generate the threshold value. Then, it is determined whether or not the output signal of the optical sensor has reached the threshold value. Finally, when it is determined that the output signal of the optical sensor has reached the threshold value, detection of a trailing edge of the output signal of the optical sensor is determined, and the peak value and the threshold value are reset.

BRIEF DESCRIPTION OF THE DRAWINGS

The above and other advantages and features of the presently disclosed subject matter will be more apparent from the following description of certain embodiments, as compared with the prior art, taken in conjunction with the accompanying drawings, wherein.

DETAILED DESCRIPTION OF EXEMPLARY EMBODIMENTS

Before the description of exemplary embodiments, prior art multi-color image forming apparatuses will now be explained with reference to FIGS. 1, 2A, 2B, 3A, 3B, 4A, 4B, 5, 6, 7A, 7B, 8A, 8B, 9A and 9B.

Figure 1:
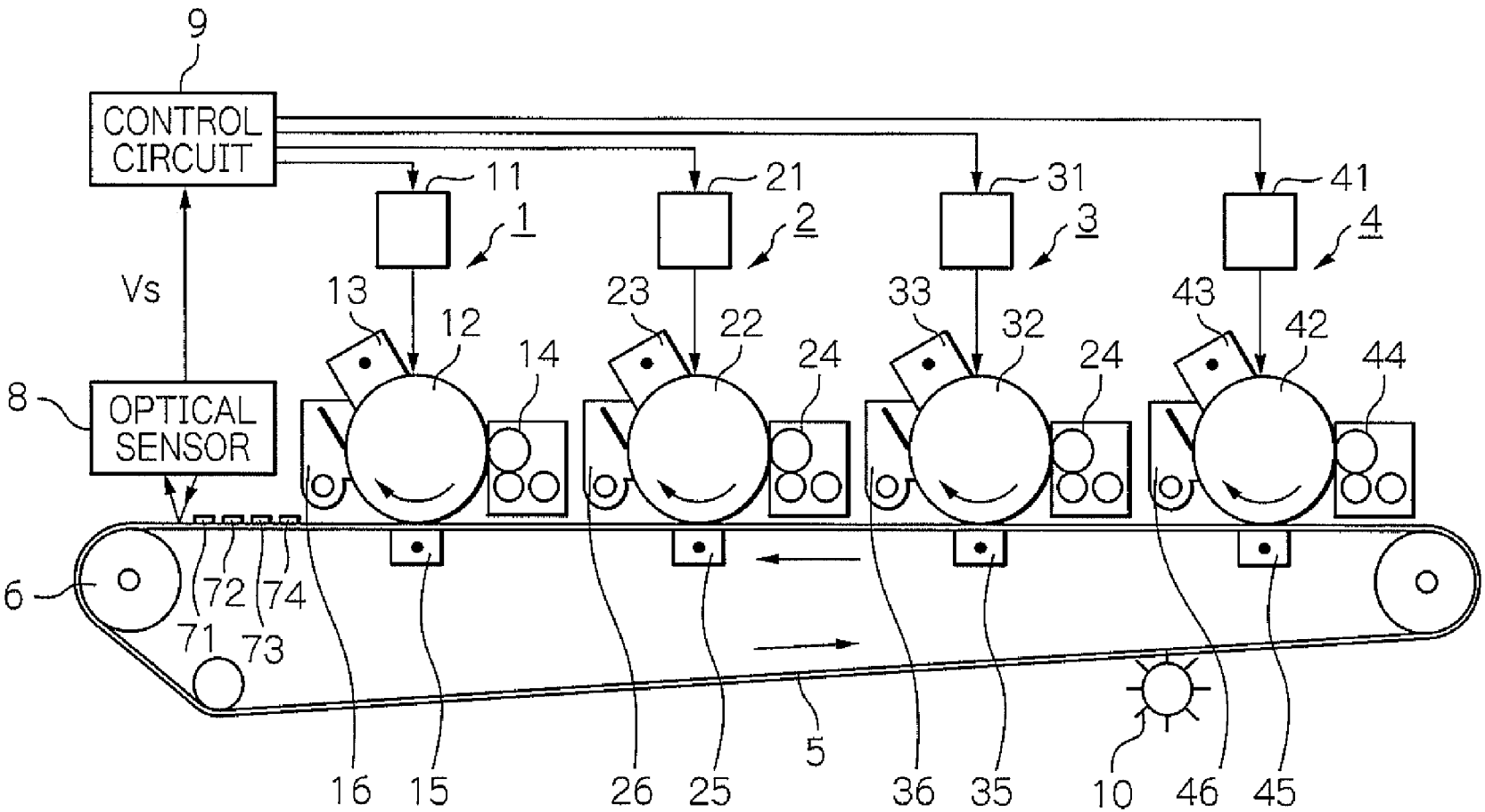
Fig. 1 PRIOR ART
FIG. 1 is a diagram illustrating a first prior art multi-color image forming apparatus.

In FIG. 1, which illustrates a first prior art multi-color image forming apparatus such as a four-drum color laser beam printer (see: JP1-167769A), four color image forming units, i.e., a magenta image forming unit 1, a cyan image forming unit 2, a yellow image forming unit 3 and a black image forming unit 4 are provided.

The magenta image forming unit 1 is constructed by an ON/OFF optical signal generating section 11 having a laser oscillator, a polygon mirror, reflection mirrors and the like, a photo drum 12, a charger 13, a developer 14, a transfer 15, and a cleaner 16.

The cyan image forming unit 2 is constructed by an ON/OFF optical signal generating section 21 having a laser oscillator, a polygon mirror, reflection mirrors and the like, a photo drum 22, a charger 23, a developer 24, a transfer 25, and a cleaner 26.

The yellow image forming unit 3 is constructed by an ON/OFF optical signal generating section 31 having a laser oscillator, a polygon mirror, reflection mirrors and the like, a photo drum 32, a charger 33, a developer 34, a transfer 35, and a cleaner 36.

The black image forming unit 4 is constructed by an ON/OFF optical signal generating section 41 having a laser oscillator, a polygon mirror, reflection mirrors and the like, a photo drum 42, a charger 43, a developer 44, a transfer 45, and a cleaner 46.

On the other hand, a transfer belt 5 is provided between the photo drums 12, 22, 32 and 42 and the transfers 15, 25, 35 and 45 to carry transfer members such as paper and toner. The transfer belt 5 is driven in an arrow-indicated direction by a drive roller 6. The photo drums 12, 22, 32 and 42 are provided equidistantly on the transfer belt 5.

For example, a magenta image transfer operation carried out by the magenta image forming unit 1 is explained below.

First, the surface of the photo drum 12 is charged uniformly by the charger 13.

Next, the surface of the photo drum 12 is scanned along its rotational axis by an ON/OFF optical signal of the ON/OFF optical signal generating section 11, so that a magenta electrostatic latent image is formed on the surface of the photo drum 12.

Next, magenta toner is adhered by the developer 14 to the electrostatic latent image on the surface of the photo drum 12, to form a magenta toner pattern.

Similarly, a cyan toner pattern, a yellow toner pattern and a black toner pattern are formed by the cyan image forming unit 2, the yellow image forming unit 3 and the black image forming unit 4, respectively.

The magenta toner pattern, the cyan toner pattern, the yellow toner pattern and the black toner pattern are sequentially transferred to the transfer member or paper by the transfers 15, 25, 35 and 45, respectively.

Finally, the magenta toner pattern, the cyan toner pattern, the yellow toner pattern and the black toner pattern are thermally fixed by a fixer (not shown) on the transfer belt 5.

In the multi-color image forming apparatus of FIG. 1, a high accuracy of transfer alignment which is referred to as registration is required among the magenta toner pattern, the cyan toner pattern and the black toner pattern on the transfer member or paper. If the registration accuracy is reduced to cause a shift of color and change of hue, the quality of images is decreased.

In order to compensate for the above-mentioned registration, a positioning magenta toner pattern 71, a positioning cyan toner pattern 72, a positioning yellow toner pattern 73 and a positioning black toner pattern 74 are formed on the transfer belt 5 by the magenta image forming unit 1, the cyan image forming unit 2, the yellow image forming unit 3, the black image forming unit 4, respectively. The positioning magenta toner pattern 71 is of a single structure made of magenta toner M, the positioning cyan toner pattern 72 is of a single structure made of cyan toner C, the positioning yellow toner pattern 73 is of a single structure made of yellow toner Y and the positioning black toner pattern 74 is of a single structure made of black toner B. These patterns 71, 72, 73 and 74 have the same shape as each other and are detected by an optical sensor 8 including a charge coupled device (CCD) sensor. In the optical sensor 8, a plane including an optical axis of emitted light and an optical axis of reflected light is in parallel with the direction of propagation of the transfer belt 5, i.e., the color toner patterns 71, 72, 73 and 74. As a result, a control circuit 9 including a central processing unit (CPU) compensates for the registration in accordance with an output signal $V_s$ of the optical sensor 8. If one of the color image forming units 1, 2, 3 and 4 is a reference color image forming unit, this compensation is carried out by adapting the three other color image forming units to the reference color image forming unit.

Note that, after the compensation of the registration is completed, the unnecessary positioning color toner patterns 71, 72, 73 and 74 are removed by a transfer belt cleaner blade 10.

In the multi-color image forming apparatus of FIG. 1, however, since the optical sensor 8 having the CCD sensor is provided to require a high speed image processing CPU, the manufacturing cost would be increased.

Also, since the positioning magenta toner pattern 71, the positioning cyan toner pattern 72, the positioning yellow toner pattern 73 and the positioning black toner pattern 74 are of a single structure, the mounting angle of the optical sensor 8 would fluctuate which would reduce the detection accuracy, as illustrated in FIGS. 2A, 2B, 3A, 3B, 4A and 4B where the emitted light of the optical sensor 8 of FIG. 1 is near infrared ($\lambda$=800~1000 nm).

Figures 2A, 2B:
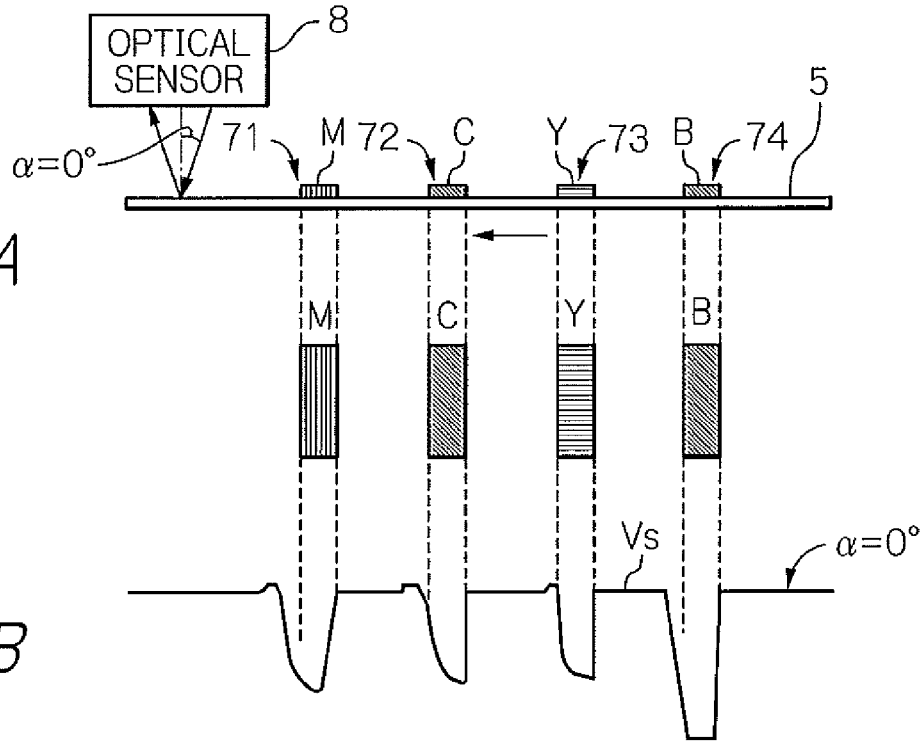
FIGS. 2A, 2B, 3A, 3B, 4A and 4B are diagrams for explaining the fluctuation of the mounting angle of the optical sensor of FIG. 1.

When the mounting angle $\alpha$ of the optical sensor 8 is 0° as illustrated in FIG. 2A, the ripple is small as illustrated in FIG. 2B.

Figures 3A, 3B:
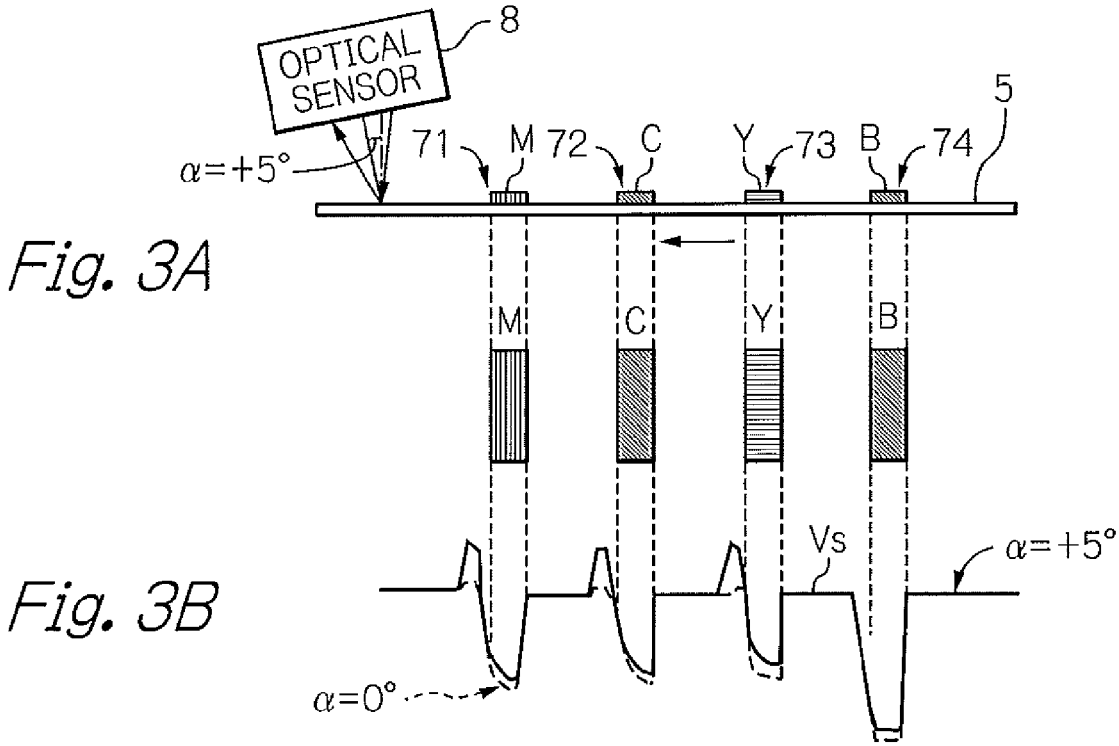

Also, when the mounting angle $\alpha$ of the optical sensor 8 is inclined toward the direction of propagation of the color toner patterns 71, 72, 73 and 74, i.e., $\alpha$=+5°, as illustrated in FIG. 3A, a large ripple may be generated in each leading edge of the output signal $V_s$ of the optical sensor 8 as illustrated in FIG. 3B, so that the ripple would be larger than that in FIG. 2B.

Figures 4A, 4B:
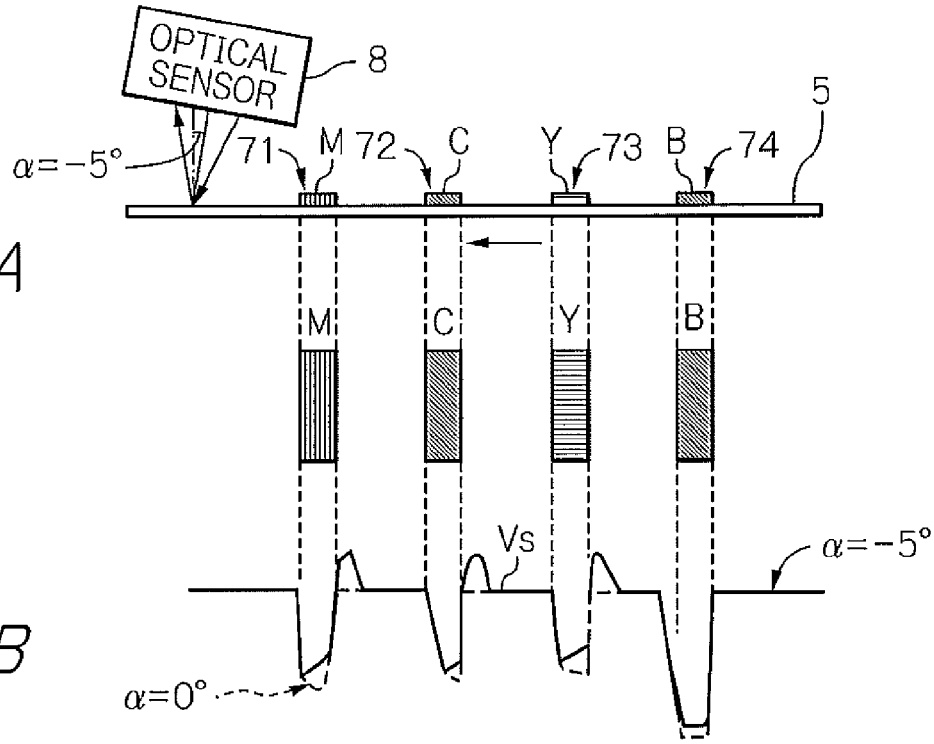

Further, when the mounting angle α of the optical sensor 8 is inclined toward a direction opposite to the direction of propagation of the color toner patterns 71, 72, 73 and 74, i.e., α=−5°, as illustrated in FIG. 4A, a large ripple may be generated in each trailing edge of the output signal $V_s$ of the optical sensor 8 as illustrated in FIG. 4B, so that the ripple would be larger than that in FIG. 2B.

Thus, when the mounting angle α of the optical sensor 8 fluctuates to increase the ripple of the output signal $V_s$ of the optical sensor 8, the detection accuracy of the color toner patterns 71, 72, 73 and 74 would be reduced.

Figure 5:
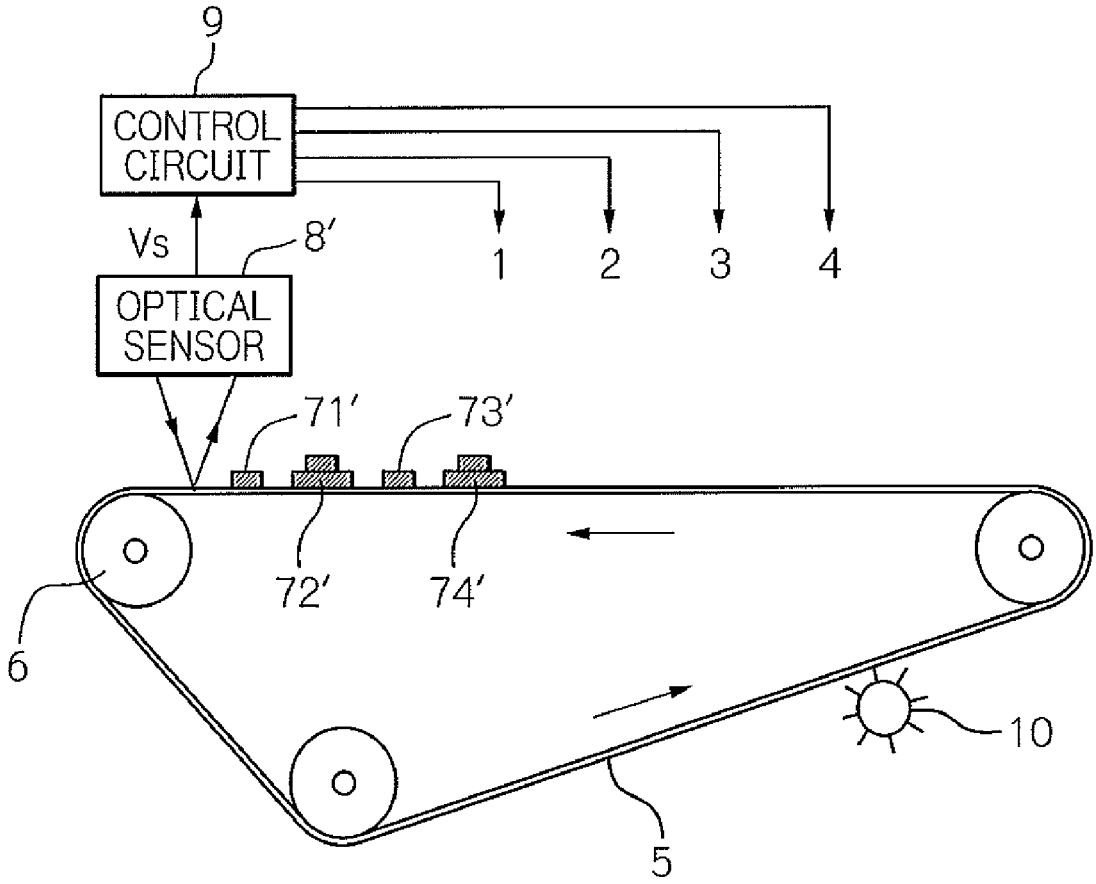
Fig. 5 PRIOR ART
FIG. 5 is a diagram illustrating a second prior art multi-color image forming apparatus.

In FIG. 5, which illustrates a second prior art multi-color image forming apparatus such as a four-drum color laser beam printer (see: JP2007-114555A), a positioning magenta toner pattern 71', a positioning cyan toner pattern 72', a positioning yellow toner pattern 73', a positioning black toner pattern 74' which have different shapes from each other, and an optical sensor 8' are provided instead of the positioning magenta toner pattern 71, the positioning cyan toner pattern 72, the positioning yellow toner pattern 73 and the positioning black toner pattern 74 which have the same shape as each other, and the optical sensor 8 of FIG. 1. Note that the color image forming units 1, 2, 3 and 4 are the same as those of FIG. 1, and therefore, the details thereof are omitted.

Figure 6:
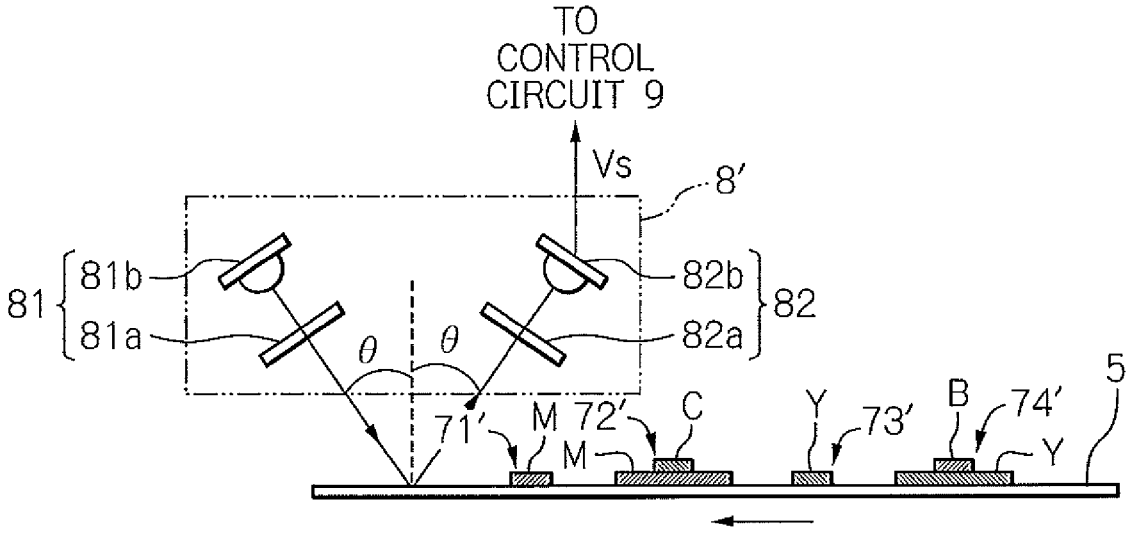
Fig. 6 PRIOR ART
FIG. 6 is a detailed diagram of the toner patterns and the optical sensor of FIG. 5.

In FIG. 6, which illustrates a detailed diagram of the toner patterns 71', 72', 73' and 74' and the optical sensor 8' of FIG. 5, if the emitted light of the optical sensor 8' is red (λ=620~730 nm), the reflectances of magenta toner M and yellow toner Y are larger than a predetermined value, while the reflectances of cyan C toner and black toner B are smaller than the predetermined value. Therefore, in this case, the positioning magenta toner pattern 71' is of a single structure made of magenta toner M, and the positioning cyan toner pattern 72' is of a double structure made of cyan toner C underlying magenta toner M. Similarly, the positioning yellow toner pattern 73' is of a single structure made of yellow toner Y, and the positioning black toner pattern 74' is of a double structure made of black toner B underlying yellow toner Y.

The optical sensor 8' is constructed by a light emitting portion 81 formed by a red light emitting diode (LED) 81*a* and a polarization element 81*b* for passing a polarized component of emitted light of the red LED 81*a*, and a light receiving portion 82 formed by a polarization element 82*a* for passing the polarized component of the emitted light and a light receiving portion 82*b*, such as a photodiode or a phototransistor for receiving light that has passed through the polarization element 82*a*. In this case, the light emitting portion 81 and the light receiving portion 82 are inclined at an angle θ with respect to a detected surface of the transfer belt 5. Also, a plane including an optical axis of emitted light and an optical axis of reflected light is in parallel with the direction of propagation of the transfer belt 5, i.e., the color toner patterns 81, 82, 83 and 84. Note that, if the red LED 81*a* is replaced by a red laser diode, the polarization element 81*b* can be omitted. Thus, the optical sensor 8' can receive only reflected light from the positioning toner patterns 71', 72', 73' and 74' to exclude reflected light from the toner carrier, i.e., the transfer belt 5.

In the multi-color image forming apparatus of FIGS. 5 and 6, since the positioning magenta toner pattern 71' of a single structure, the positioning cyan toner pattern 72' of a double structure, the positioning yellow toner pattern 73' of a single structure, the positioning black toner pattern 74' of a double structure are provided, even if the mounting angle α of the optical sensor 8 would fluctuate, the detection accuracy would not be reduced as illustrated in FIGS. 7A, 7B, 8A, 8B, 9A and 9B.

Figures 7A, 7B:
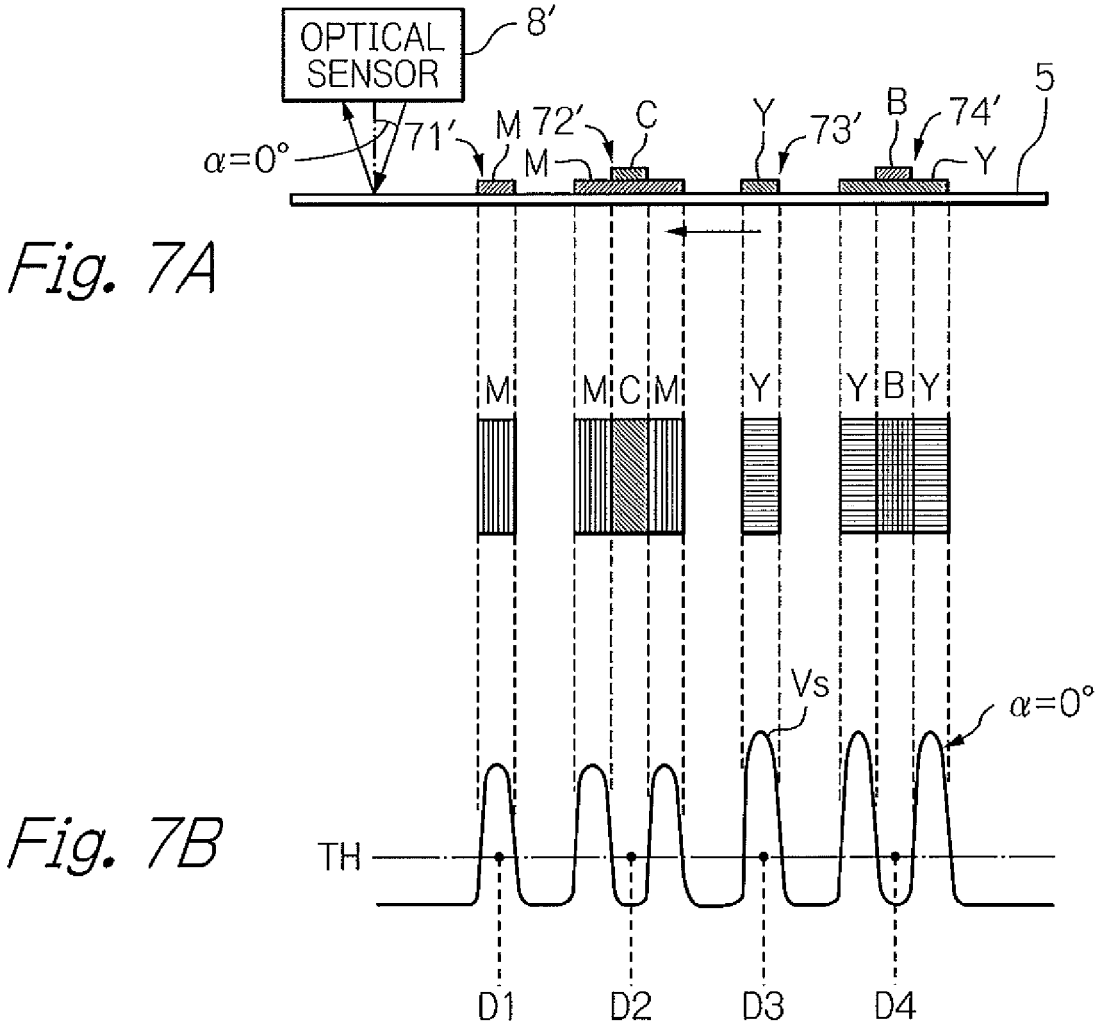
FIGS. 7A, 7B, 8A, 8B, 9A and 9B are diagrams for explaining the fluctuation of the mounting angle of the optical sensor of FIGS. 5 and 6.

When the mounting angle α of the optical sensor 8' is 0° as illustrated in FIG. 7A, the ripple is small as illustrated in FIG. 7B. That is, each of the magenta toner pattern 71' and the yellow toner pattern 73' are detected by one high reflective pattern whose value is larger than a threshold value TH, so that each of detected position data D1 and D3 is calculated by a gravity center calculation method using two position values by which the output signal $V_s$ reaches the threshold value TH. Also, each of the cyan toner pattern 72' and the black toner pattern 74' is detected by two high reflective patterns whose values are larger than the threshold value TH, so that each of detected position data D2 and D4 is calculated by the gravity center calculation method using four position values by which the output signal $V_s$ reaches the threshold value TH.

Figure 8A:
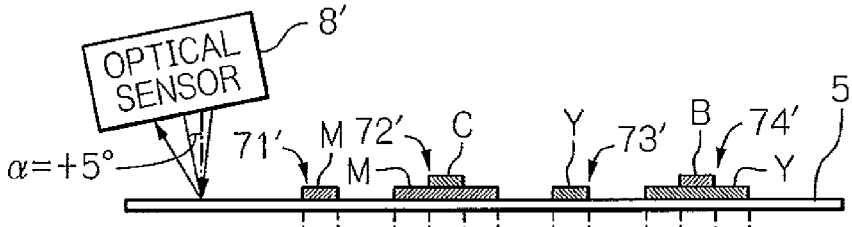
Figure 8B:
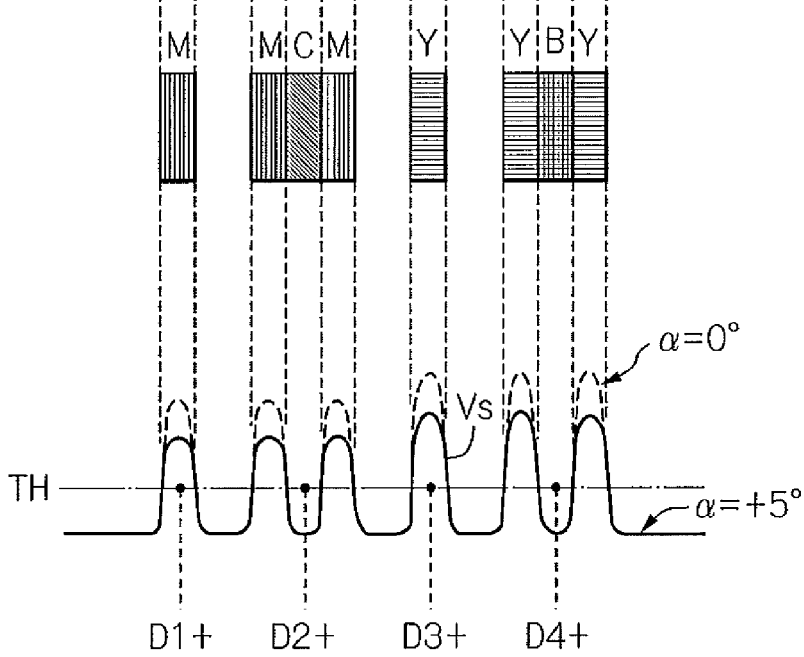

Also, even when the mounting angle α of the optical sensor 8' is inclined toward the direction of propagation of the toner patterns 71', 72', 73' and 74', i.e., α=+5°, as illustrated in FIG. 8A, the ripple is small as illustrated in FIG. 8B. That is, each of the magenta toner pattern 71' and the yellow toner pattern 73' is detected by one high reflective pattern whose value is larger than the threshold value TH, so that each of detected position data D1+ and D3+ is calculated by the gravity center calculation method using two position values by which the output signal $V_s$ reaches the threshold value TH. Also, each of the cyan toner pattern 72' and the black toner pattern 74' is detected by two high reflective patterns whose values are larger than the threshold value TH, so that each of detected position data D2+ and D4+ is calculated by the gravity center calculation method using four position values by which the output signal $V_s$ reaches the threshold value TH.

Figures 9A, 9B:
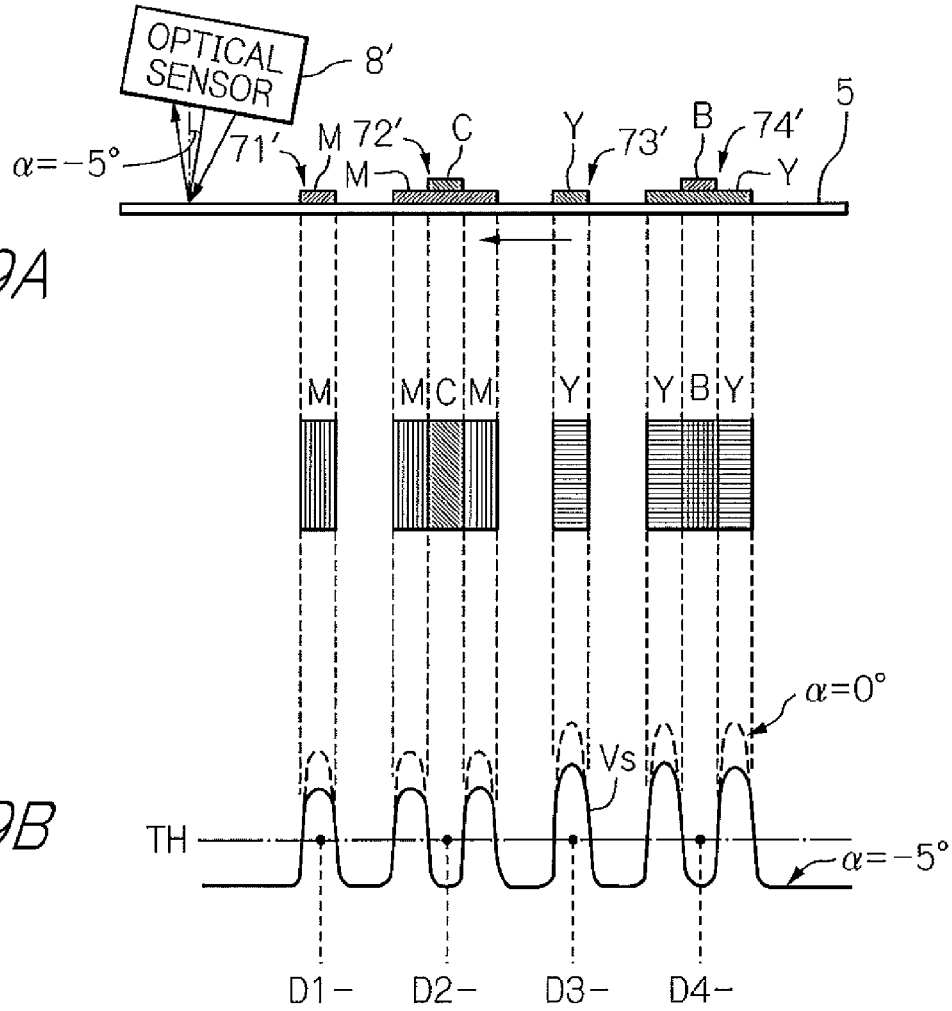

Further, even when the mounting angle α of the optical sensor 8' is inclined toward a direction opposite to the direction of propagation of the toner patterns 71', 72', 73' and 74', i.e., α=−5°, as illustrated in FIG. 9A, the ripple is small as illustrated in FIG. 9B. That is, each of the magenta toner pattern 71' and the yellow toner pattern 73' is detected by one high reflective pattern whose value is larger than the threshold value TH, so that each of detected position data D1− and D3− is calculated by the gravity center calculation method using two position values by which the output signal $V_s$ reaches the threshold value TH. Also, each of the cyan toner pattern 72' and the black toner pattern 74' is detected by two high reflective patterns whose values are larger than the threshold value TH, so that each of detecting position data D2− and D4− is calculated by the gravity center calculation method using four position values by which the output signal $V_s$ reaches the threshold value TH.

That is, since the difference between the detected position data Di and Di± (i=1, 2, 3 and 4) is ±tens of μm, the detection accuracy of the positioning toner patterns can be improved; however, this detection accuracy is still low.

Note that the gravity center calculation method is carried out by software (programs) stored in a memory of the control circuit 9.

Figure 10A:
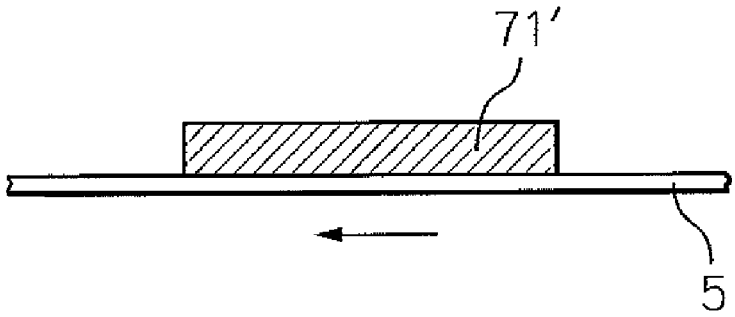
FIG. 10 is a cross-sectional view illustrating examples of the positioning toner patterns of FIGS. 5 and 6.
Figure 10B:
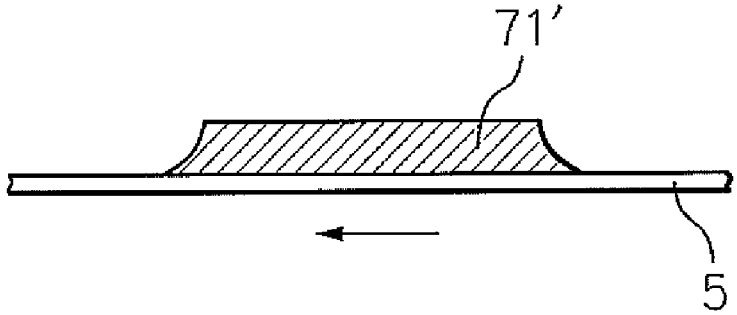
Figure 10C:
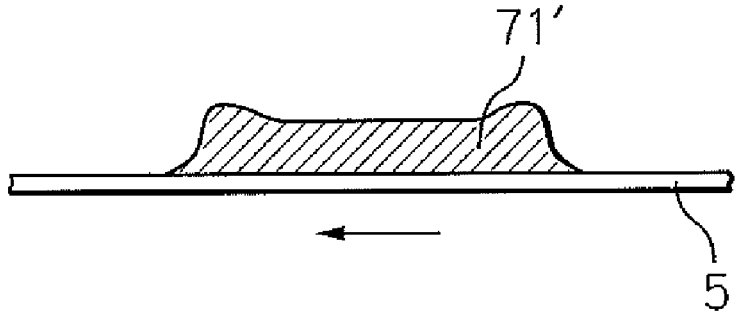

The color toner pattern such as 71' ideally has a rectangular cross section as illustrated in FIG. 10A; however, the color toner pattern such as 71' actually has a trapezoidal cross section as illustrated in FIG. 10B and a bell-shaped cross section as illustrated in FIG. 10C. Therefore, the detection accuracy of the positioning toner patterns would actually become lower.

Figure 11A:
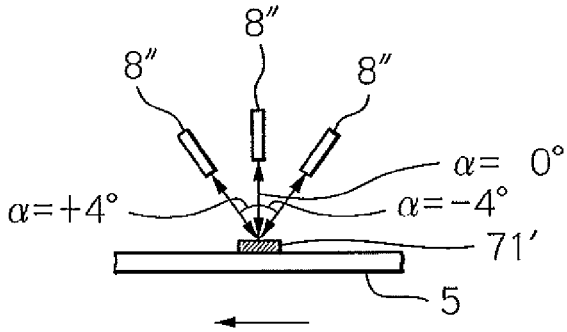
FIGS. 11A and 11B are diagrams for explaining the fluctuation of the mounting angle of a modification of the optical sensor of FIGS. 5 and 6.
Figure 11B:
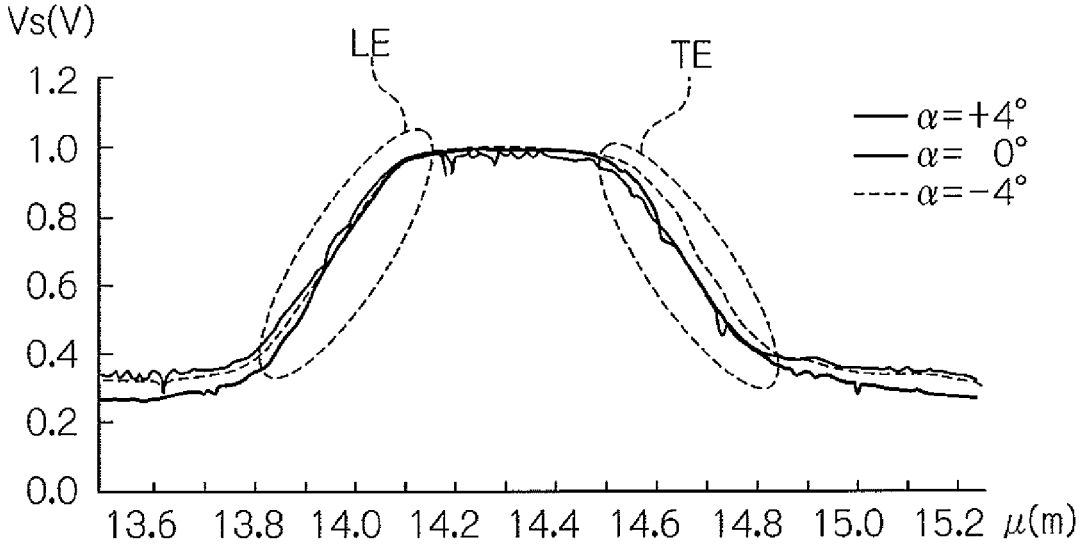

The inventor considered that the detection accuracy of the positioning toner patterns would be further improved by replacing the optical sensor 8' of FIGS. 5 and 6 with an the optical sensor 8" as illustrated in FIG. 11A where a plane including an optical axis of emitted light and an optical axis of reflected light is perpendicular to the direction of propagation of the transfer belt 5, i.e., the color toner patterns 71', 72', 73' and 74'. In this case, when the mounting angle $\alpha$ of the optical sensor 8" is inclined toward the direction of propagation of the toner pattern 71', i.e., $\alpha=+4°$, as illustrated in FIG. 11A, a leading edge LE of the output signal $V_s$ of the optical sensor 8" leads about 40 μm corresponding to about 20 μm of gravity center as compared with the leading edge LE where $\alpha=0°$. On the other hand, when the mounting angle $\alpha$ of the optical sensor 8" is inclined toward a direction opposite to the direction of propagation of the toner pattern 71', $\alpha=-5°$, as illustrated in FIG. 11A, a trailing edge TE of the output signal $V_s$ of the optical sensor 8" lags about 50 μm corresponding to about 25 μm of gravity center as compared with the trailing edge TE where $\alpha=0°$. Note that the color toner patterns 72', 73' and 74' also actually have similar cross sections to those of FIGS. 10B and 10C. Thus, even when the optical sensor 8" is used, the detection accuracy of the positioning color toner patterns cannot be ±several μm and is still low.

Figure 12:
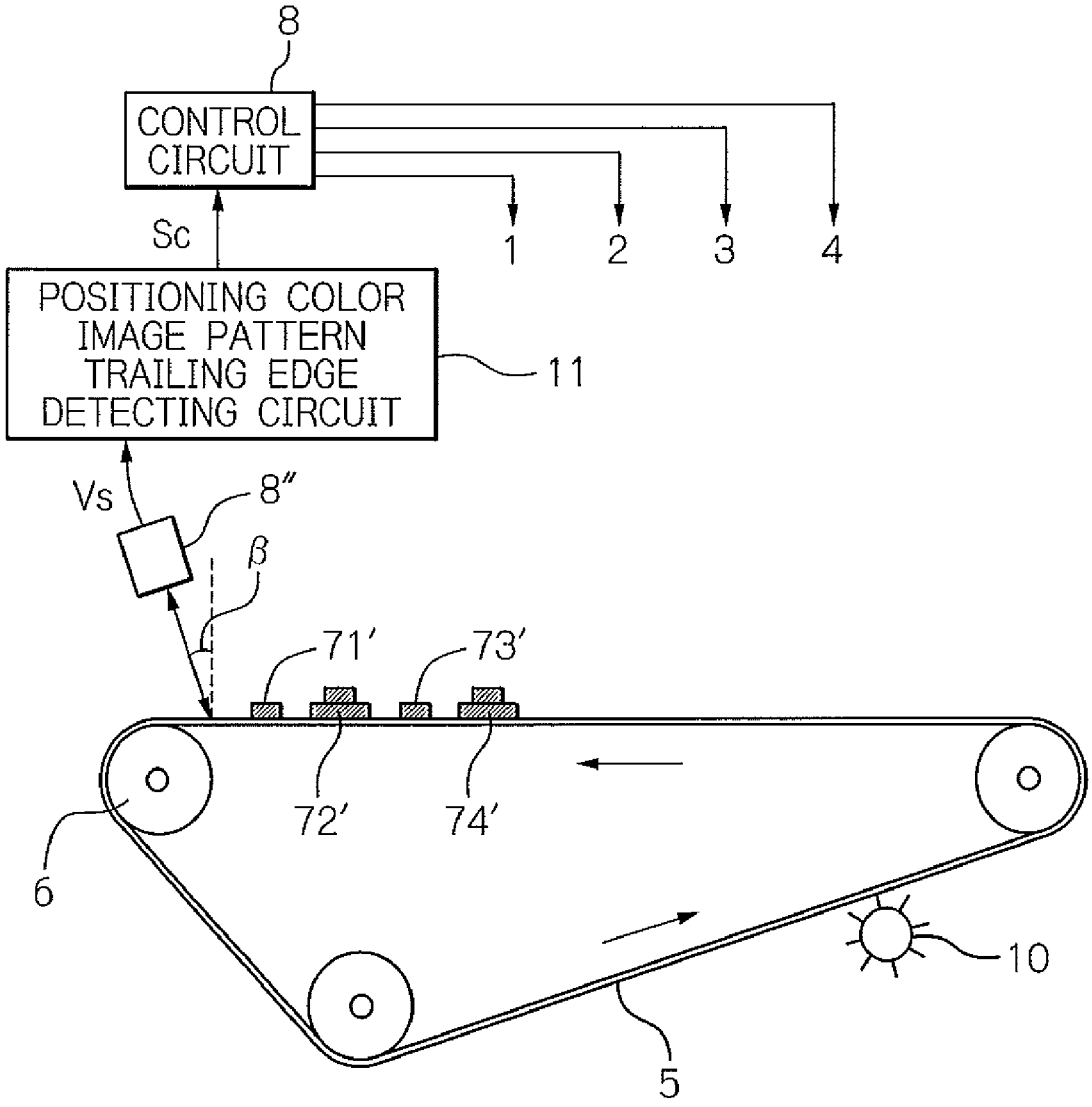
FIG. 12 is a diagram illustrating a first embodiment of the multi-color image forming apparatus according to the presently disclosed subject matter.

In FIG. 12, which illustrates a first embodiment of the multi-color image forming apparatus according to the presently disclosed subject matter, a positioning color image pattern trailing edge detecting circuit 11 is added to the elements of the multi-color image forming apparatus of FIG. 5, and the optical sensor 8' of FIG. 5 is replaced with the optical sensor 8" which was discussed with reference to FIG. 11A.

The optical sensor 8" of FIG. 12 is explained below with reference to FIGS. 13A, 13B and 13C which area front view, a top view and a side view, respectively, of the optical sensor 8".

Figure 13A:
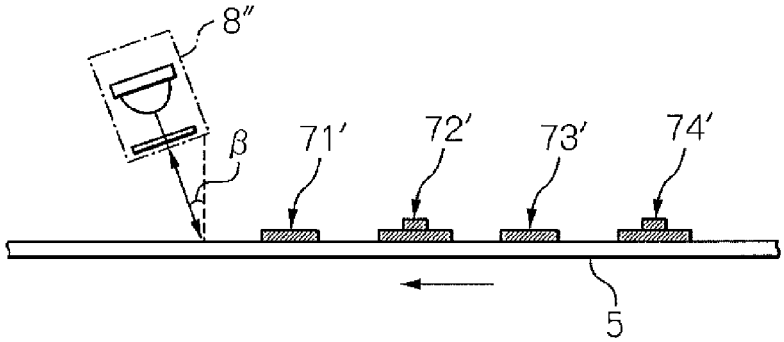
FIGS. 13A, 13B and 13C are a front view, a top view and a side view, respectively, of the optical sensor of FIG. 12.
Figure 13B:
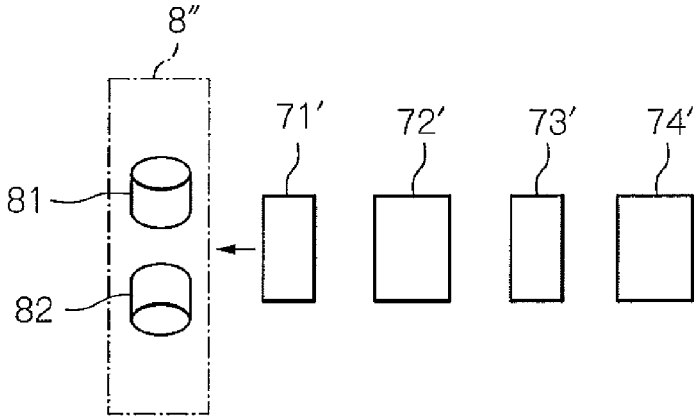
Figure 13C:
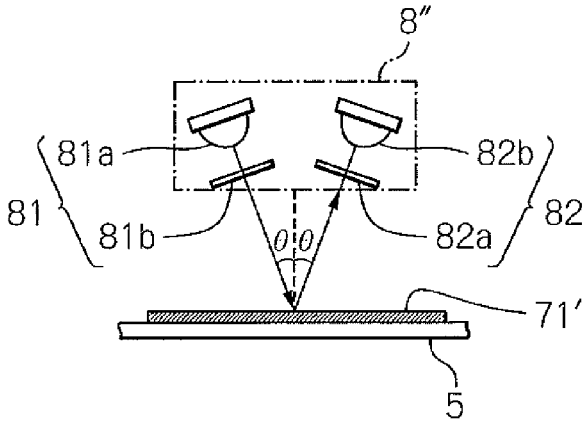

As illustrated in FIGS. 13A, 13B and 13C, the internal structure of the optical sensor 8" is the same as that of the optical sensor 8' of FIG. 6; however, a plane including an optical axis of emitted light from the light emitting portion 81 and an optical axis of reflected light to the light receiving portion 82 is perpendicular to the direction of propagation of the transfer belt 5, i.e., the color toner patterns 71', 72', 73' and 74'. Also, the mounting angle $\beta$ of the optical sensor 8" is inclined toward the direction of propagation of the transfer belt 5, i.e., the color toner patterns 71', 72', 73' and 74' in advance. For example, $\beta=10°$. In this case, even if the mounting angle $\beta$ fluctuates from $\beta-\alpha$ to $\beta+\alpha$, the mounting angle $\beta$ is from 5° to 10° where $\alpha=5°$. Thus, since an elongated detection area of the optical sensor 8" is perpendicular to the direction of propagation of the transfer belt 5, this elongated detection area covers each of the toner patterns 71', 72', 73' and 74', which would improve the detection accuracy of the color toner patterns 71', 72', 73' and 74'.

Also, in the optical sensor 8", the polarization element of alight emitting portion can emit a single polarized component, and the polarization element of a light receiving portion can receive a polarized component different from the above-mentioned polarized component.

Figure 14:
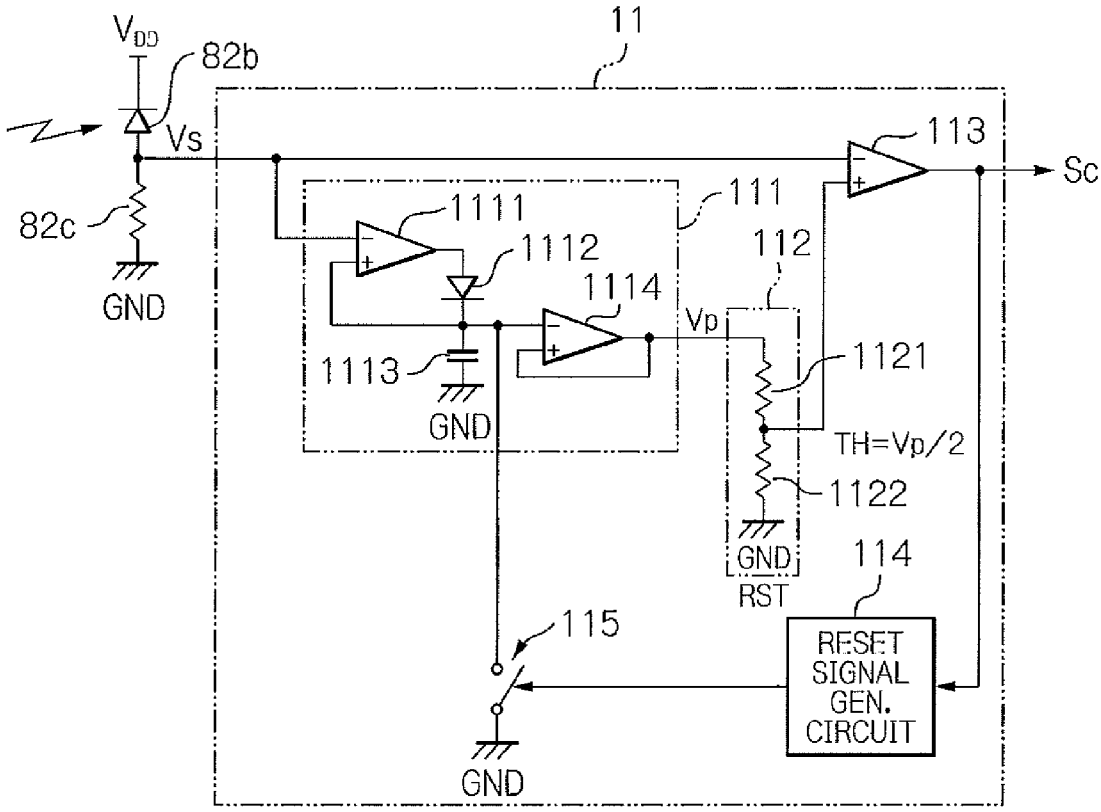
FIG. 14 is a circuit diagram of the positioning color image pattern detecting circuit of FIG. 12.

In FIG. 14, which is a circuit diagram of the positioning color image pattern trailing edge detecting circuit 11 of FIG. 12, the positioning color image pattern trailing edge detecting circuit 11 is constructed by a peak hold circuit 111 for holding a peak value $V_p$ of the output signal $V_s$ of the light receiving element 82*b*, a voltage divider 112 for dividing the peak value $V_p$ to generate a threshold value TH, a comparator 112 for comparing the output signal $V_s$ of the light receiving element 82*b* with the threshold value TH to generate a comparison signal $S_c$, a reset signal generating circuit 114 for delaying the comparison signal $S_c$ by a predetermined delay time period td to generate a reset signal RST, and a reset circuit 115 connected between the peak hold circuit 111 and the ground GND for receiving the reset signal RST to reset the peak value $V_p$ of the peak hold circuit 111. In this case, the comparison signal $S_c$ of the comparator 113 is supplied as an output of the positioning color image pattern trailing edge detecting circuit 11 to the control circuit 9. Note that the light receiving element 82*b* has an end connected to a power supply terminal $V_{DD}$ and another end connected via a resistor 82*c* to the ground GND.

In more detail, the peak hold circuit 111 is constructed by an operational amplifier 1111 serving as an amplifier, a diode 1112 and a capacitor 1113 for holding the peak value $V_p$ of the output signal $V_s$ of the light receiving element 82*b*, and an operational amplifier 1114 serving as an voltage buffer. In this case, the peak value $V_p$ is generated from the output of the operational amplifier 114.

The voltage divider 112 is constructed by a series of resistors 1121 and 1122. For example, if the resistance value of the resistor 1121 is the same as that of the resistor 1122, $$TH=V_p/2$$

That is, the threshold value TH is a predetermined ratio of the peak value $V_p$, for example, half of the peak value $V_p$.

Figure 15:
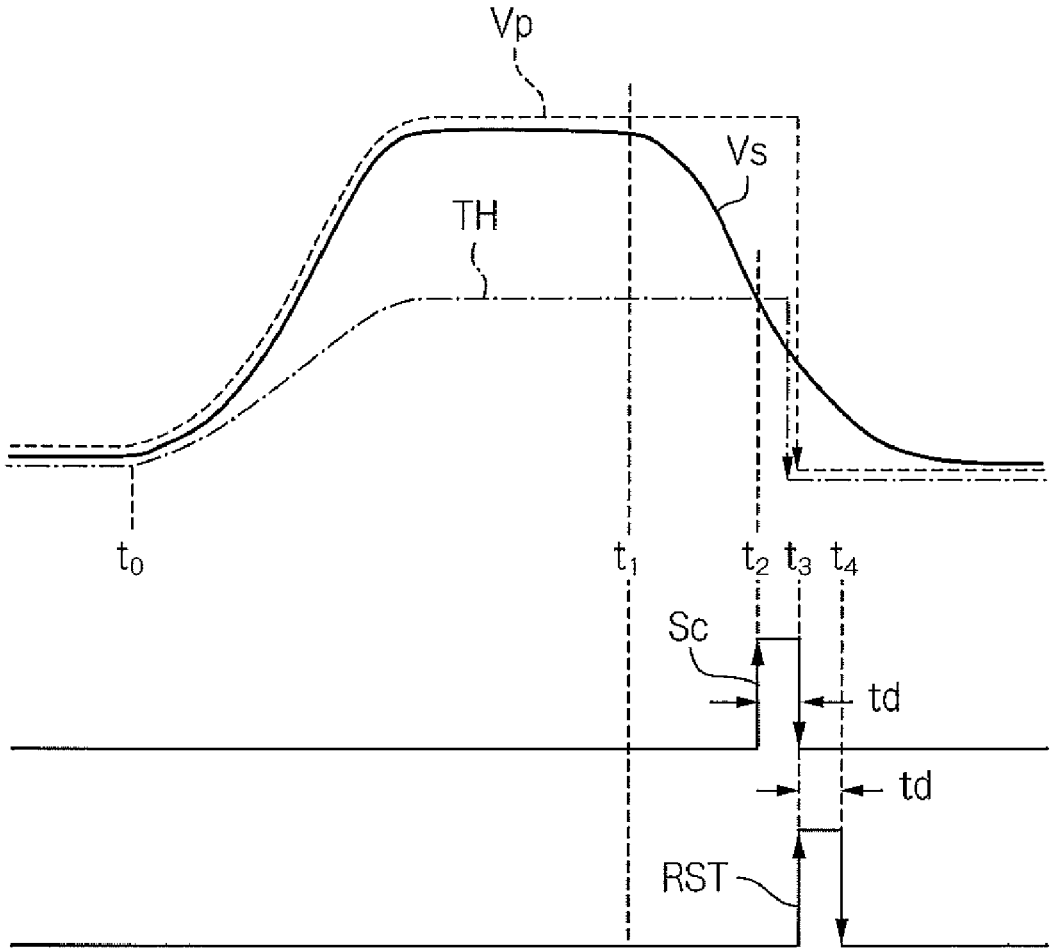
FIG. 15 is a timing diagram for explaining the operation of the positioning color image pattern detecting circuit of FIG. 14.

The operation of the positioning color image pattern trailing edge detecting circuit 11 of FIG. 14 is explained below with reference to FIG. 15.

Assume that the output signal $V_s$ of the light receiving element 82*b* rises at time t0 and falls at time t1. As a result, from time t0 to time t1, the peak value $V_p$ follows the output signal $V_s$, i.e., $V_p=V_s$, so that the threshold value TH follows half of the peak value $V_p$ or half of the output signal $V_s$, i.e., $TH=V_p/2=V_s/2$. In this case, the comparison signal $S_c$ is at a low level and the reset signal RST is at a low level.

Next, at time t2, when the output signal $V_s$ reaches the threshold value TH, the comparison signal $S_c$ is switched from the low level to a high level.

Next, at time t3 after the delay time period td has passed, the reset signal RST is switched from the low level to a high level.

When the reset signal RST is switched from the low level to the high level, the peak value $V_p$ and the threshold value TH is reset, so that the comparison signal $S_c$ falls. Then, after the delay time period td has passed, the reset signal RST also falls.

Thus, a trailing edge of the output signal $V_s$ can be detected at time t2 by the comparison signal $S_c$ generated from the comparison of the output signal $V_s$ with the threshold value TH.

The detection accuracy of the color toner patterns by the multi-color forming apparatus of FIG. 12 is explained below with reference to FIGS. 16A, 16B, 16C, 17A, 17B and 17C.

Figures 16A, 16B, 16C:
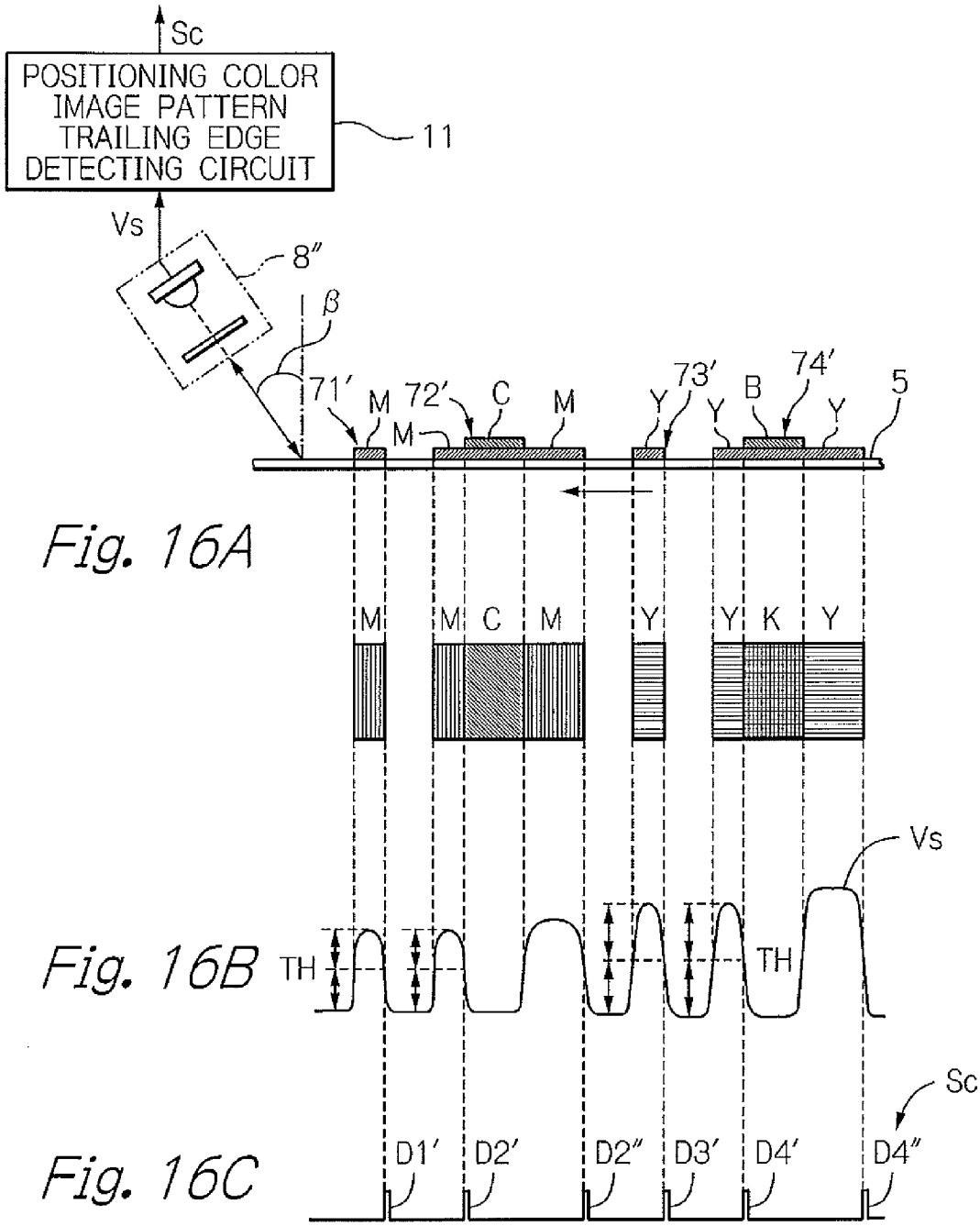
FIGS. 16A, 16B, 16C, 17A, 17B and 17C are diagrams for explaining the fluctuation of the mounting angle of the optical sensor of FIG. 12.

In FIG. 16A, since the positioning magenta toner pattern 71' of a single structure, the positioning cyan toner pattern 72' of a double structure, the positioning yellow toner pattern 73' of a single structure, the positioning black toner pattern 74' of a double structure are provided in the same way as in FIGS. 7A, 8A and 9A, and the optical sensor 8" and the positioning color image pattern trailing edge detecting circuit 11 are provided, even if the mounting angle $\beta$ of the optical sensor 8" fluctuates, the detection accuracy of the color toner patterns is high as illustrated in FIGS. 16B and 16C.

That is, even if the mounting angle $\beta$ of the optical sensor 8" fluctuates as illustrated in FIG. 16A, each trailing edge of the output signal $V_s$ of the optical sensor 8" would not be changed as illustrated in FIG. 16B, so that trailing edge position data D1', D2', D2", D3', D4', D4" are precisely detected when the output signal $V_s$ reaches the threshold value TH following the output signal $V_s$ as illustrated in FIG. 16C. Thus, the detection accuracy is not so reduced by the fluctuation of the mounting angle β of the optical sensor 8". For example, the detection accuracy is several μm.

Note that since the trailing edge position data D2" and D4" are unnecessary, the trailing edge position data D2" and D4" are removed by software (programs) of the control circuit 9.

Figures 17A, 17B, 17C:
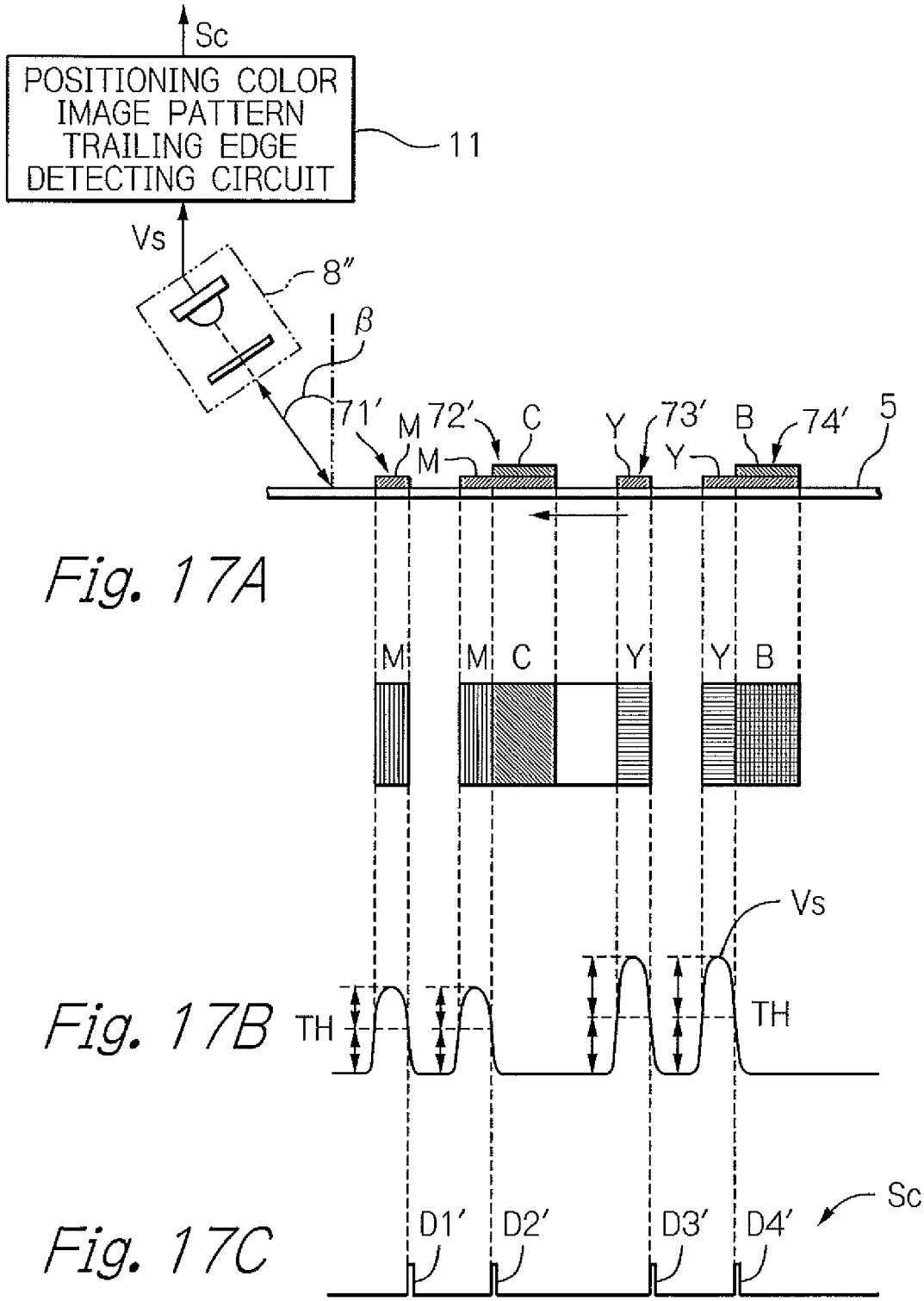

On the other hand, in FIG. 17A, in the positioning cyan toner pattern 72', the underlined magenta toner M is exposed only in the direction of propagation of the transfer belt 5, not in a direction opposite to the direction of propagation. That is, the trailing edge of the cyan toner C is located at the trailing edge of the underlined magenta toner M. Similarly, in the positioning black toner pattern 74', the underlined yellow toner Y is exposed only in the direction of propagation of the transfer belt 5, not in a direction opposite to the direction of propagation. That is, the trailing edge of the black toner B is located at the trailing edge of the underlined yellow toner Y. As a result, as illustrated in FIG. 17B, enhanced regions of the output signal $V_s$ of the optical sensor 8" at a trailing edge of the cyan toner pattern 72' and at a trailing edge of the black toner B of the positioning black toner pattern 74' can be neglected. Therefore, as illustrated in FIG. 17C, the trailing edge position data D2" and D4" of FIG. 16C are not detected, so that the removal of the trailing edge position data D2" and D4" is unnecessary.

As illustrated in FIGS. 16A and 17A, in the positioning cyan toner pattern 72', the leading edge of the cyan toner C is retarded from the leading edge of the underlined magenta toner M, and in the positioning black toner pattern 74', the leading edge of the black toner B is retarded from the leading edge of the underlined yellow toner Y.

Figure 18:
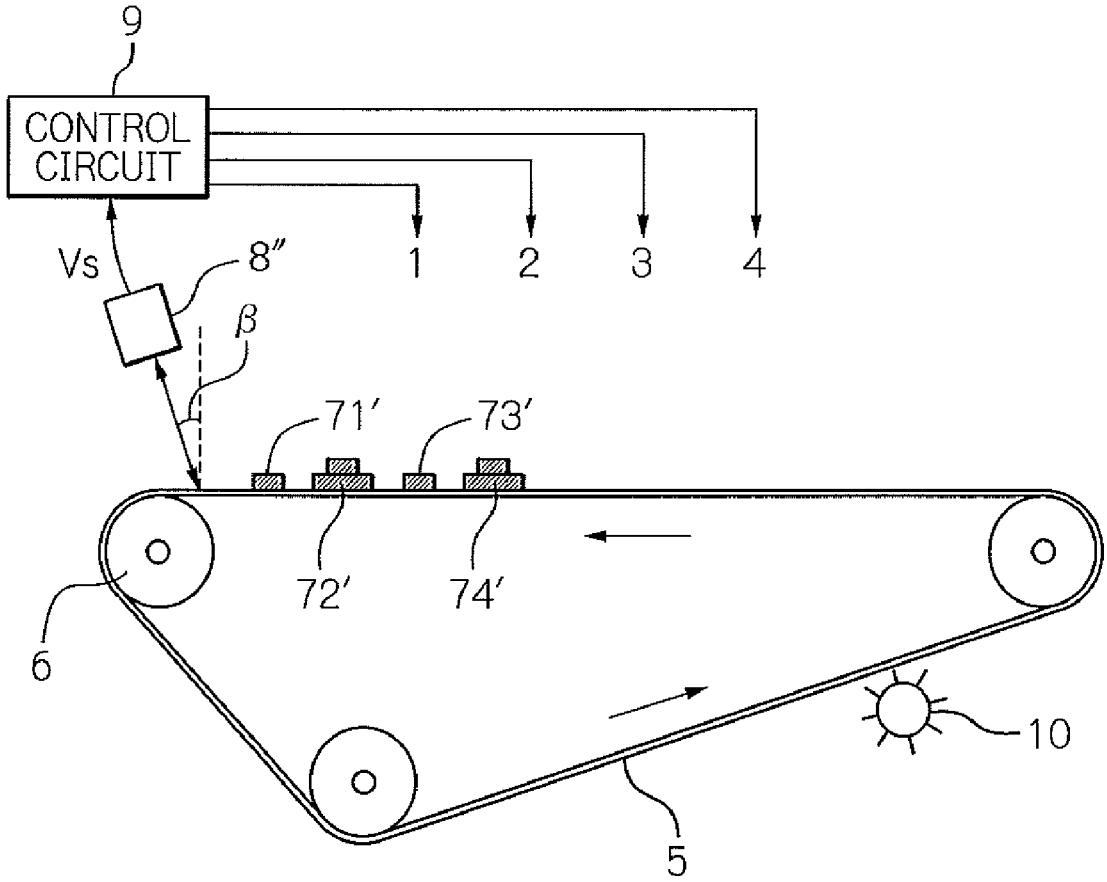
FIG. 18 is a diagram illustrating a second embodiment of the multi-color image forming apparatus according to the presently disclosed subject matter.
Figure 19:
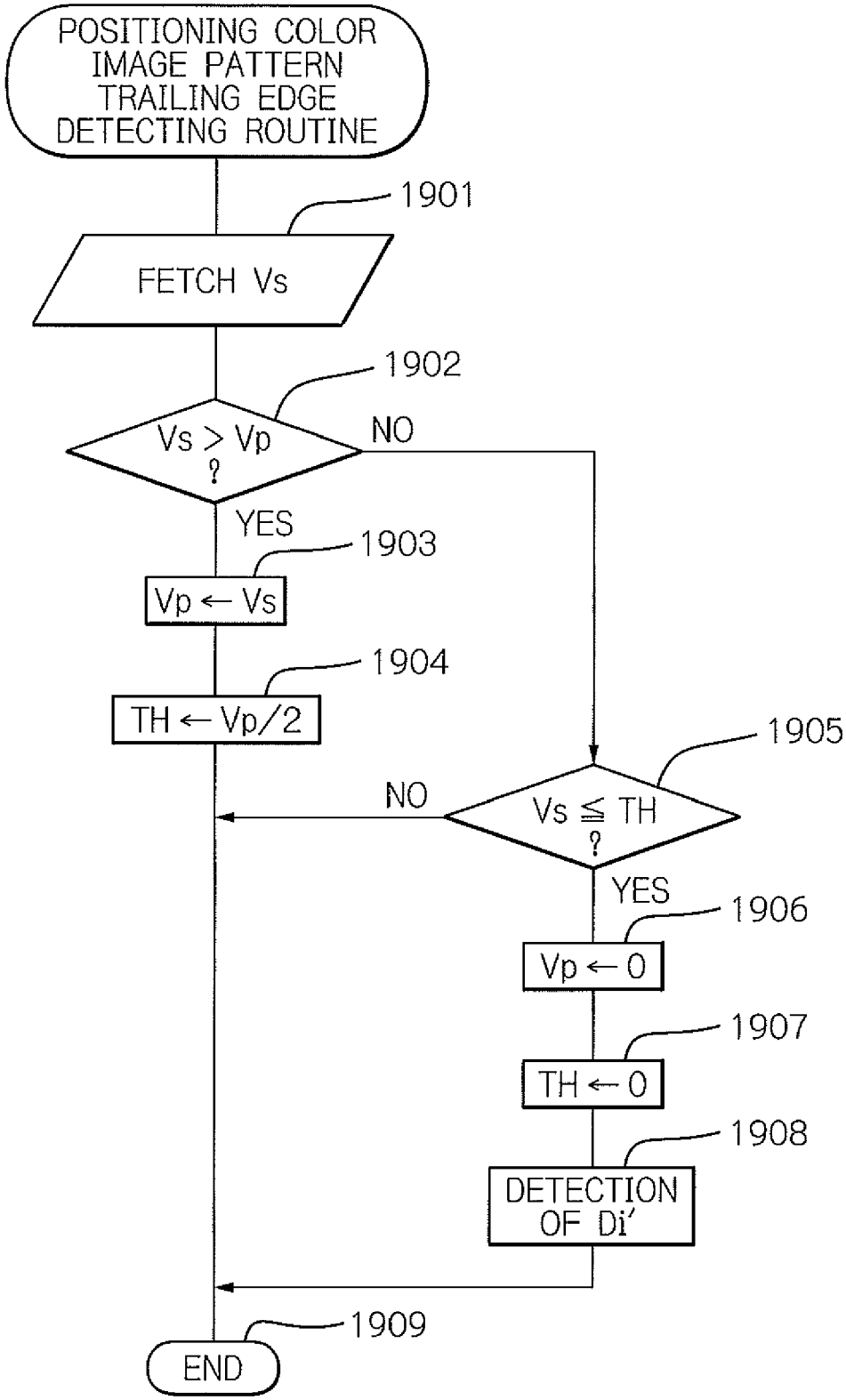
FIG. 19 is a flowchart for explaining the positioning color image pattern detecting operation of the control circuit of FIG. 18.

In FIG. 18, which illustrates a second embodiment of the multi-color image forming apparatus according to the presently disclosed subject matter, the positioning color image pattern trailing edge detecting circuit 11 of FIG. 12 is omitted, and, instead of this, the operation of the positioning color image pattern trailing edge detecting circuit 11 of FIG. 12 is carried out by the control circuit 9 using a flowchart as illustrated in FIG. 19. This positioning color image pattern trailing edge detecting routine is executed at predetermined times corresponding to a predetermined length of the transfer belt 5. Also, when the power is turned ON, the peak value $V_p$ and the threshold value TH are initially reset, i.e., $V_p$=TH=0.

First, at step 1901, an analog-to-digital (A/D) conversion is performed upon the output signal $V_s$ of the optical sensor 8".

Next, at step 1902, it is determined whether or not $V_s>V_p$ is satisfied. As a result, only when $V_s>V_p$, does the control proceed to step 1903 and 1904. Otherwise, the control proceeds to step 1905.

At step 1903, the peak value $V_p$ is renewed by $V_s$, and at step 1904, the threshold value TH is renewed by $V_p/2$. Then, the control proceeds to step 1909.

At step 1905, it is determined whether or not the output signal $V_s$ reaches the threshold value TH, i.e., whether or not $V_s \leqq V_p$ is satisfied. As a result, only when $V_s \leqq V_p$, does the control proceed to step 1906, 1907 and 1908. Otherwise, the control proceeds to step 1909.

At step 1906, the peak value $V_p$ is reset, i.e., $V_p$=0, and at step 1907, the threshold value TH is reset, i.e., TH=0. Then, at step 1908, a trailing edge position Di' is detected as the current time or the position of the transfer belt 5. Then, the control proceeds to step 1909.

Thus, trailing edge positions D1', D2' (D2"), D3', D4' (D4") can be detected by the flowchart of FIG. 19.

Note that the above-mentioned flowchart of FIG. 19 can be stored in a read-only memory (ROM) or another nonvolatile memory or in a random access memory (RAM) or another volatile memory of the control circuit 9.

In the above-described embodiments, since the optical sensor 8" is inclined toward the direction of propagation of the transfer belt 5, i.e., the color toner patterns 71', 72', 73' and 74', the fluctuation of each trailing edge of the output signal $V_s$ of the optical sensor 8" is suppressed even when the mounting angle β of the optical sensor 8" fluctuates. In this case, as stated above, the mounting angle β of the optical sensor 8" is set in view of the fluctuation α of the mounting angle β from β−α to β+α where β≧α. However, if the mounting angle β is too large, the detection accuracy would be reduced. Particularly, if the optical sensor 8" is configured to receive an irregular reflected light, i.e., a polarized component of reflected light different from a polarized component of emitted light, the larger the mounting angle β, the smaller the irregular reflected light.

Figure 20:
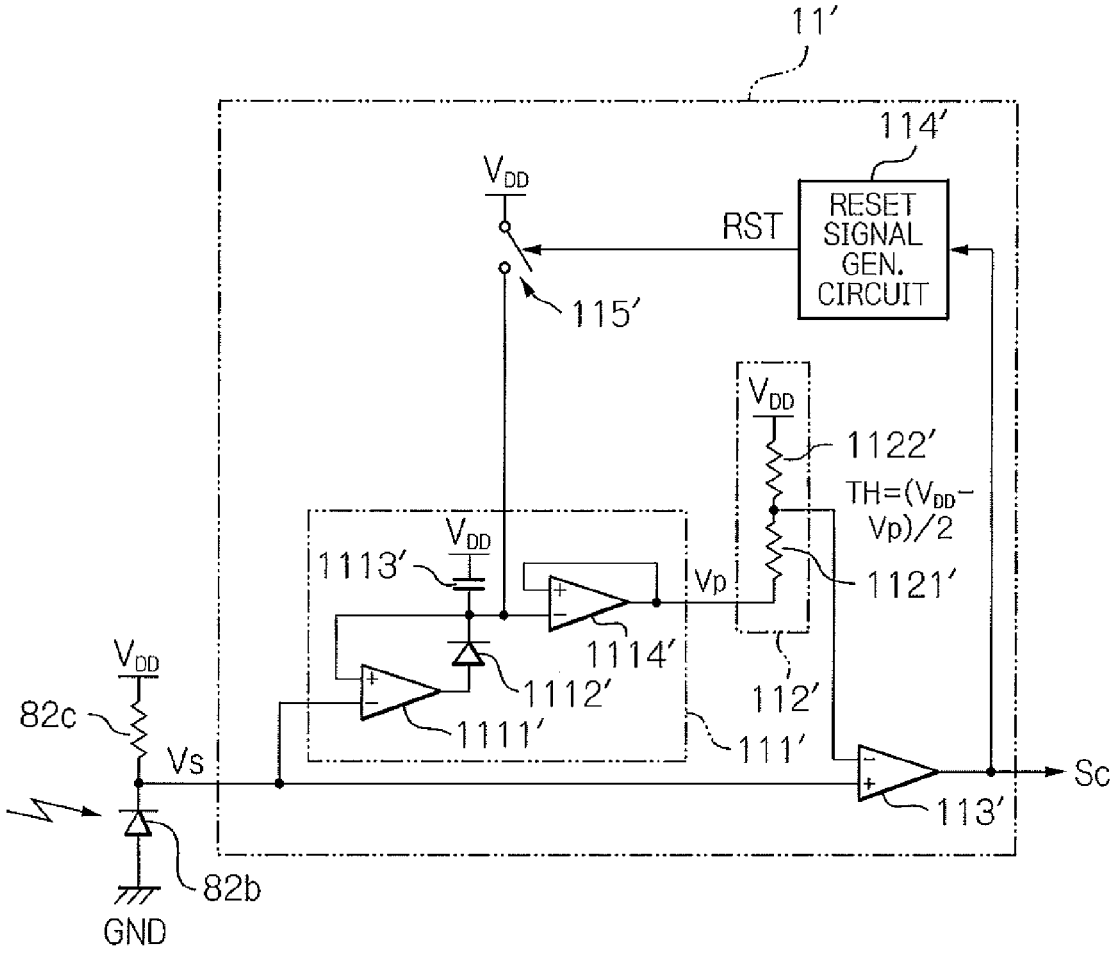
FIG. 20 is a circuit diagram illustrating a modification of the positioning color image pattern detecting circuit of FIG. 14.
Figure 21:
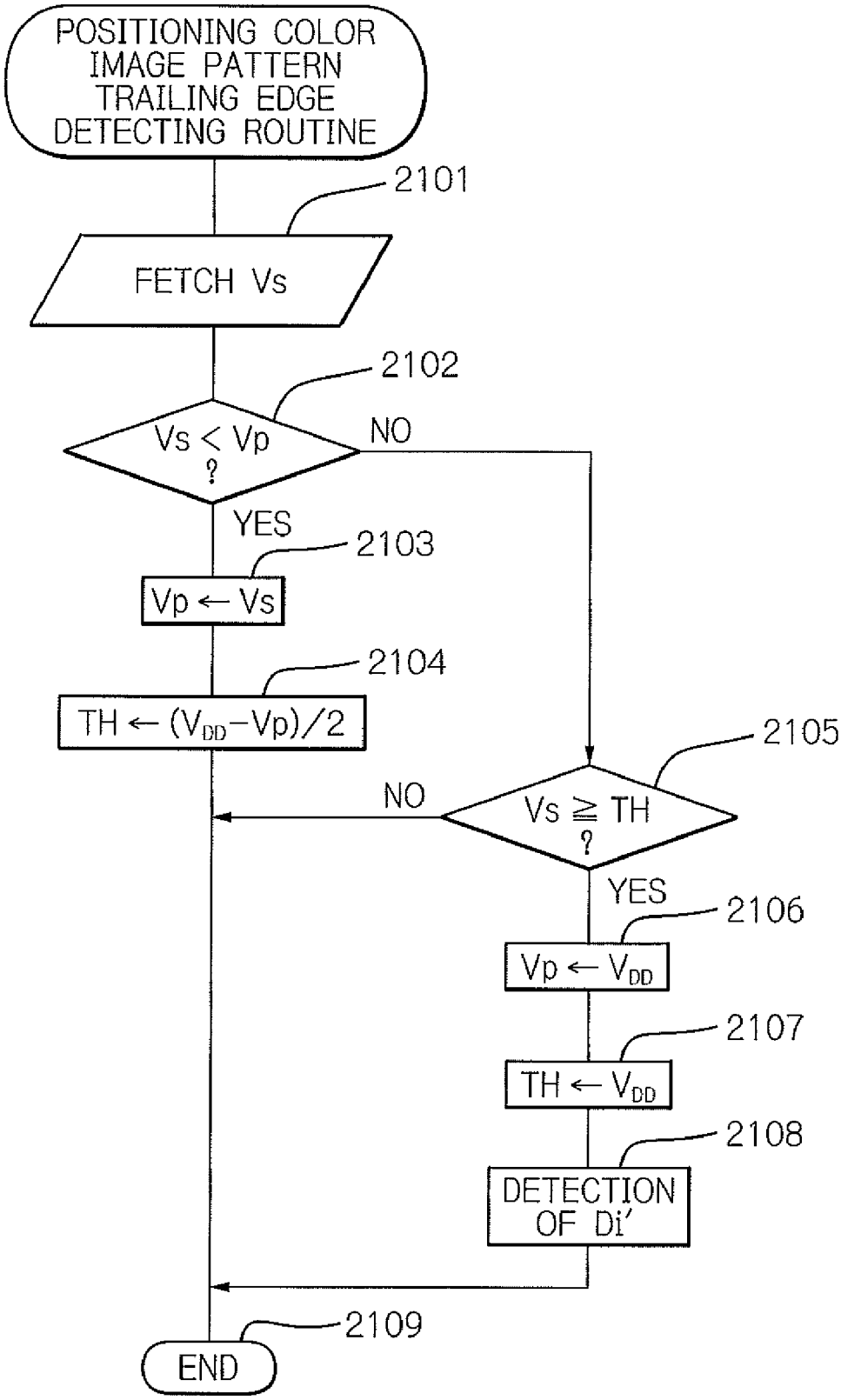
FIG. 21 is a flowchart illustrating a modification of the flowchart of FIG. 19.

Also, in the above-described embodiments, the peak value $V_p$ is the maximum value of the output signal $V_s$ of the optical sensor 8"; however, when the connection of the receiving element 82*b* is changed as illustrated in FIG. 20, the peak value $V_p$ is the minimum value of the output signal $V_s$ of the optical sensor 8". In FIG. 20, elements 11', 111', 1111', 1112', 1113', 1114', 112', 1121', 1122', 113' and 114' correspond to elements 11, 111, 1111, 1112, 1113, 1114, 112, 1121, 1122, 113 and 114, respectively. Also, in the case, the flowchart of FIG. 19 is modified to a flowchart as illustrated in FIG. 21.

In the positioning color image pattern trailing edge detecting routine, when the power is turned ON, the peak value $V_p$ and the threshold value TH are initially reset, i.e., $V_p$=TH=$V_{DD}$.

First, at step 2101, an A/D conversion is performed upon the output signal $V_s$ of the optical sensor 8".

Next, at step 2102, it is determined whether or not $V_s<V_p$ is satisfied. As a result, only when $V_s<V_p$, does the control proceed to step 2103 and 2104. Otherwise, the control proceeds to step 2105.

At step 2103, the peak value $V_p$ is renewed by $V_s$, and at step 1904, the threshold value TH is renewed by $(V_{DD}-V_p)/2$. Then, the control proceeds to step 2109.

At step 2109, it is determined whether or not the output signal $V_s$ reaches the threshold value TH, i.e., whether or not $V_s \geqq V_p$ is satisfied. As a result, only when $V_s \geqq V_p$, does the control proceed to step 2106, 2107 and 2108. Otherwise, the control proceeds to step 2109.

At step 2106, the peak value $V_p$ is reset, i.e., $V_p$=$V_{DD}$, and at step 2107, the threshold value TH is reset, i.e., TH=$V_{DD}$. Then, at step 2108, a trailing edge position Di' is detected as the current time or the position of the transfer belt 5. Then, the control proceeds to step 2109.

Thus, trailing edge positions D1', D2' (D2"), D3', D4' (D4") can be detected by the flowchart of FIG. 21.

Further, in the above-described embodiments, the positioning cyan toner pattern 72' can be of double structure of cyan toner C underlying yellow toner Y, and the positioning black toner pattern 74' can be of double structure of black toner C underlying magenta toner M.

It will be apparent to those skilled in the art that various modifications and variations can be made in the presently disclosed subject matter without departing from the spirit or scope of the presently disclosed subject matter. Thus, it is intended that the presently disclosed subject matter covers the modifications and variations of the presently disclosed subject matter provided they come within the scope of the appended claims and their equivalents. All related or prior art references described above and in the Background section of the present specification are hereby incorporated in their entirety by reference.

What is claimed is:

1. A multi-color image forming apparatus comprising:

a plurality of color image forming units adapted to form a plurality of different color images;

a transfer belt to which positioning color image patterns are transferred by said color image forming units;

an optical sensor adapted to detect said positioning color image patterns;

a positioning color image pattern trailing edge detecting circuit adapted to detect trailing edges of said positioning color image patterns by determining that an output signal of said optical sensor has reached a threshold value, said threshold value being a predetermined ratio of a peak value of the output signal of said optical sensor; and a control circuit adapted to compensate for registration of said color image forming units in accordance with the detected trailing edges of said positioning color image patterns.

2. The multi-color image forming apparatus as set forth in claim 1, wherein, when a first one of said positioning color image patterns has a larger reflectance for an emitted light from said optical sensor than a predetermined value, said first positioning color image pattern is of a single structure, when a second one of said positioning color image patterns has a smaller reflectance for the emitted light from said optical sensor than said predetermined value, said second positioning color image pattern is of a double structure of said second positioning color image pattern underlying a third positioning color image pattern which has a larger reflectance for the emitted light from said optical sensor than said predetermined value, said second positioning color image pattern having a leading edge retarded from a leading edge of said third positioning color image pattern with respect to a direction of propagation of said transfer belt.

3. The multi-color image forming apparatus as set forth in claim 2, wherein, said second positioning color image pattern has a trailing edge forwarded from a leading edge of said third positioning color image pattern with respect to the direction of propagation of said transfer belt.

4. The multi-color image forming apparatus as set forth in claim 2, wherein, said second positioning color image pattern has a trailing edge located at a leading edge of said third positioning color image pattern with respect to the direction of propagation of said transfer belt.

5. The multi-color image forming apparatus as set forth in claim 1, wherein said color image forming units are a magenta image forming unit, a cyan image forming unit, a yellow image forming unit and a black image forming unit, said magenta image forming unit transferring first and second positioning magenta toner patterns to said transfer belt, said cyan image forming unit transferring a positioning cyan toner pattern underlying said second magenta toner pattern to said transfer belt, said positioning cyan toner pattern having a leading edge retarded from a leading edge of said second magenta toner pattern with respect to a direction of propagation of said transfer belt, said yellow image forming unit transferring first and second positioning yellow toner patterns to said transfer belt, said black image forming unit transferring a positioning black toner pattern underlying said second yellow toner pattern to said transfer belt, said positioning black toner pattern having a leading edge retarded from a leading edge of said second yellow toner pattern with respect to a direction of propagation of said transfer belt.

6. The multi-color image forming apparatus as set forth in claim 5, wherein said positioning cyan toner pattern has a trailing edge forwarded from a trailing edge of said second magenta toner pattern with respect to the direction of propagation of said transfer belt, and wherein said positioning black toner pattern has a trailing edge forwarded from a trailing edge of said second yellow toner pattern with respect to the direction of propagation of said transfer belt.

7. The multi-color image forming apparatus as set forth in claim 5, wherein said positioning cyan toner pattern has a trailing edge located at a trailing edge of said second magenta toner pattern with respect to the direction of propagation of said transfer belt, and wherein said positioning black toner pattern has a trailing edge located at a trailing edge of said second yellow toner pattern with respect to the direction of propagation of said transfer belt.

8. The multi-color image forming apparatus as set forth in claim 1, wherein said color image forming units are a magenta image forming unit, a cyan image forming unit, a yellow image forming unit and a black image forming unit, said magenta image forming unit transferring first and second positioning magenta toner patterns to said transfer belt, said yellow image forming unit transferring first and second positioning yellow toner patterns to said transfer belt, said cyan image forming unit transferring a positioning cyan toner pattern underlying said second yellow toner pattern to said transfer belt, said positioning cyan toner pattern having a leading edge retarded from a leading edge of said second yellow toner pattern with respect to a direction of propagation of said transfer belt, said black image forming unit transferring a positioning black toner pattern underlying said second magenta toner pattern to said transfer belt, said positioning black toner pattern having a leading edge retarded from a leading edge of said second magenta toner pattern with respect to a direction of propagation of said transfer belt.

9. The multi-color image forming apparatus as set forth in claim 8, wherein said positioning cyan toner pattern has a trailing edge forwarded from a trailing edge of said second yellow toner pattern with respect to the direction of propagation of said transfer belt, and wherein said positioning black toner pattern has a trailing edge forwarded from a trailing edge of said second magenta toner pattern with respect to the direction of propagation of said transfer belt.

10. The multi-color image forming apparatus as set forth in claim 8, wherein said positioning cyan toner pattern has a trailing edge located at a trailing edge of said second yellow toner pattern with respect to the direction of propagation of said transfer belt, and wherein said positioning black toner pattern has a trailing edge located at a trailing edge of said second magenta toner pattern with respect to the direction of propagation of said transfer belt.

11. The multi-color image forming apparatus as set forth in claim 1, wherein said optical sensor comprises:

a light emitting portion for emitting light; and a light receiving portion adapted to receive reflected light of said emitted light from said positioning color image patterns, a plane including an optical axis of said light emitting portion and an optical axis of said light receiving portion being perpendicular to a direction of propagation of said transfer belt and being inclined toward the direction of propagation of said transfer belt.

12. The multi-color image forming apparatus as set forth in claim 11, wherein said light emitting portion generates a single polarized component and said light receiving portion receives a polarized component different from said single polarized component.

13. The multi-color image forming apparatus as set forth in claim 1, wherein said positioning color image pattern trailing edge detecting circuit comprises:

a peak hold circuit adapted to hold said peak value of the output signal of said optical sensor;

a voltage divider connected to said peak hold circuit and adapted to divide said peak value to generate said threshold value;

a comparator connected said voltage divider and adapted to compare the output signal of said optical sensor with said threshold value to generate a comparison signal for showing the trailing edges of said positioning color image patterns;

a reset signal generating circuit connected to said comparator and adapted to delay said comparison signal by a predetermined delay time period to generate a reset signal; and a reset circuit connected between said reset signal generating circuit and said peak hold circuit and adapted to reset said peak hold circuit in accordance with said reset signal.

14. The multi-color image forming apparatus as set forth in claim 13, wherein said peak value is a maximum value of the output signal of said optical sensor.

15. The multi-color image forming apparatus as set forth in claim 13, wherein said peak value is a minimum value of the output signal of said optical sensor.

16. A method for detecting positioning color image patterns in a multi-color image forming apparatus comprising:

a plurality of color image forming units adapted to form a plurality of different color images;

a transfer belt to which positioning color image patterns are transferred by said color image forming units; and an optical sensor adapted to detect said positioning color image patterns, said method comprising:

holding said peak value of the output signal of said optical sensor;

dividing said peak value to generate said threshold value;

determining whether or not the output signal of said optical sensor has reached said threshold value;

determining detection of a trailing edge of the output signal of said optical sensor and resetting said peak value and said threshold value when it is determined that the output signal of said optical sensor has reached said threshold value.

17. The method as set forth in claim 16, wherein said peak value is a maximum value of the output signal of said optical sensor.

18. The method as set forth in claim 16, wherein said peak value is a minimum value of the output signal of said optical sensor.

* * * * *